US006450150B1

(12) United States Patent
Sanden et al.

(10) Patent No.: US 6,450,150 B1
(45) Date of Patent: Sep. 17, 2002

(54) FEED UNIT TO BE ARRANGED IN A FUEL TANK

(75) Inventors: Eduard Sanden, Wiesbaden; Joachim Korn, Limburg/Lahn, both of (DE)

(73) Assignee: Siemens, Frankfurt (DE)

( * ) Notice: Subject to any disclaimer, the term of this patent is extended or adjusted under 35 U.S.C. 154(b) by 0 days.

(21) Appl. No.: 09/618,089

(22) Filed: Jul. 17, 2000

(30) Foreign Application Priority Data

Jul. 15, 1999 (DE) ..... 199 33 046

(51) Int. Cl.[7] ..... F02M 37/04

(52) U.S. Cl. ..... 123/509; 417/363; 137/565.24

(58) Field of Search ..... 123/509, 510, 123/514, 516; 417/363, 364, 360; 137/565, 24

(56) References Cited

U.S. PATENT DOCUMENTS

| | | | | |
|---|---|---|---|---|
| 4,865,522 A | * | 9/1989 | Radermacher | 417/203 |
| 4,971,017 A | * | 11/1990 | Beakley et al. | 123/510 |
| 5,002,467 A | * | 3/1991 | Talaski et al. | 417/363 |
| 5,038,741 A | * | 8/1991 | Tuckey | 123/509 |
| 5,482,444 A | * | 1/1996 | Coha et al. | 417/363 |
| 6,216,734 B1 | * | 4/2001 | Umetsu et al. | 137/565.24 |

FOREIGN PATENT DOCUMENTS

| | | | |
|---|---|---|---|
| DE | 2735917 C2 | 8/1977 | F02M/37/10 |
| DE | 2750081 A1 | 9/1977 | F02M/37/08 |
| DE | 3523079 A1 | 6/1985 | F16L/37/08 |
| DE | 3721977 A1 | 3/1987 | F02M/37/10 |
| DE | 3700679 C2 | 7/1988 | F16L/55/02 |
| DE | 37 06 119 C2 | 8/1988 | F16L/55/02 |
| DE | 4441476 A1 | 11/1994 | F04C/15/00 |
| DE | 69508076 T2 | 11/1995 | F02M/69/54 |
| DE | 19753781 A1 | 4/1997 | F16B/21/18 |
| DE | 19723410 A1 | 6/1997 | F16L/33/10 |

* cited by examiner

*Primary Examiner*—Carl S. Miller
(74) *Attorney, Agent, or Firm*—Mayer, Brown, Rowe & Maw

(57) ABSTRACT

A fuel feed unit includes a spring element for holding a fuel pump arranged so as to be longitudinally displaceable within a receiving part. The fuel pump is held radially by the spring element and is prestressed axially against a holding element. The feed unit can thereby be produced particularly cost-effectively and makes it possible to mount fuel pumps of different power ratings.

15 Claims, 1 Drawing Sheet

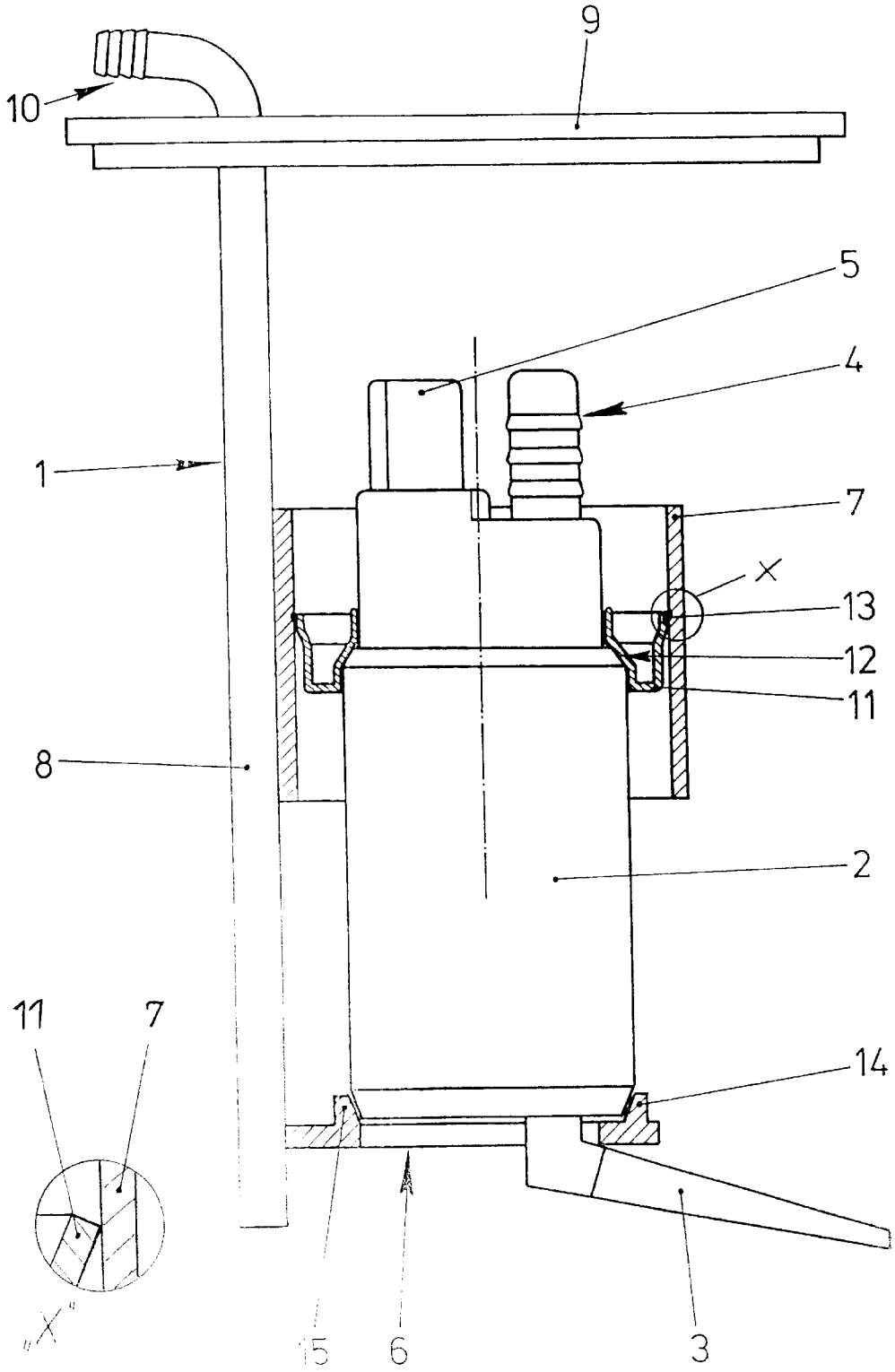
9
10
5
4
1
7
X
13
12
11
8
2
11
7
14
"X"
15
6
3

FEED UNIT TO BE ARRANGED IN A FUEL TANK

BACKGROUND OF THE INVENTION

1. Field of the Invention

The present invention relates to a feed unit to be arranged in a fuel tank having a fuel pump for feeding fuel to an internal combustion engine of a motor vehicle.

2. Description of the Related Art

Feed units are often used in present-day motor vehicles and are generally known in the field. The holding part of the known feed unit has two annularly designed caps engaged over the ends of the fuel pump. The caps are clamped together by means of a holding clasp. The fuel pump is held in the fuel tank at the holding clasp or at one of the caps. An O-ring is arranged under one of the caps for tolerance compensation.

A disadvantage of the known feed unit is that the holding part has to be manufactured separately in each case to compensate for varying heights of different fuel pumps. This leads, in the case of feed units provided for different power ratings, to a high structural and cost-intensive outlay for adapting the holding part. Furthermore, the fuel pump is usually composed of a plurality of components. As a result, tolerances of the components may add up in such a way that the holding clasp can no longer be mounted on the caps or the fuel pump will not be held reliably.

The problem on which the invention is based is to design a feed unit of the type initially mentioned, in such a way that it is constructed as simply as possible and can be produced particularly cost-effectively.

SUMMARY OF THE INVENTION

The shortcomings and problems of the prior art are solved, in accordance with the invention, in a device that includes a holding part which has a holding element that axially secures the fuel pump. A receiving part at least partially surrounds the fuel pump and has at least one spring element. The spring element on the receiving part can be locked at different distances from the holding element in the receiving part and is designed to hold the fuel pump in the radial direction.

By this design, fuel pumps of different length can be fastened in the holding part, since the spring element can simply be locked on the receiving part according to the dimensions of the fuel pump. Fuel pumps of appropriate length can therefore be manufactured for different power ratings. The feed unit according to the invention requires only a single holding part for reliably holding a feed unit having different power ratings. Diameter or length tolerances are likewise compensated by the spring element. The feed unit consists of particularly few components and is therefore constructed in a particularly simple way. The mounting of the feed unit according to the invention is particularly simple due to the small number of movable components.

The receiving part could, for example, be of a C-shaped design. However, according to an advantageous alternate exemplary embodiment of the invention, the receiving part has particularly high stability if it is designed as a tubular piece.

According to another advantageous alternate exemplary embodiment of the invention, the fuel pump is held reliably in its intended position if the spring element is designed to surround the fuel pump annularly. Furthermore, by virtue of this design, the transmission of vibrations of the fuel pump to the holding part is avoided.

According to another advantageous development of the invention, tilting of the fuel pump can be avoided if the holding element has projections laterally holding the fuel pump.

According to another advantageous exemplary embodiment of the invention, the spring element can be manufactured particularly cost-effectively if the spring element is designed as a molding manufactured from plastic by the injection molding method. According to another advantageous exemplary embodiment of the invention, the spring element withstands particularly high temperatures if the spring element is manufactured from metal.

According to another advantageous exemplary embodiment of the invention, the spring element can be manufactured particularly cost-effectively if it has an essentially U-shaped cross section. For example, the manufacture of the spring element from plastic is carried out in an axial-removal injection mold.

According to another advantageous exemplary embodiment of the invention, the spring element, after being mounted, is held reliably in the receiving part if the spring element has an edge prestressed against the receiving part.

The receiving part could, for example, have a catch arrangement for the edge of the spring element. However, according to another advantageous exemplary embodiment of the invention, the spring element can dig automatically into the receiving part if the receiving part is manufactured from a softer material than the spring element. The spring element is thereby held positively in the receiving part in the axial direction.

According to another advantageous development of the invention, a contribution to further simplifying the mounting of the fuel pump to the holding part is made if the spring element is designed for prestressing the fuel pump against the holding element.

The feed unit according to an exemplary embodiment of the invention has a particularly simple design if the fuel pump has a contraction on its side facing away from the holding element and if the spring element comes to bear in the region of the contraction.

According to another advantageous exemplary embodiment of the invention, the spring element holds the fuel pump in the radial and axial directions if the contraction is designed conically. According to another advantageous exemplary embodiment of the invention, the spring element can be mounted in a particularly simple way if the U-shaped spring element is arranged with its closed end pointing toward the holding part. For mounting, the spring element is simply pressed, with the closed end in front, into the receiving part, until the fuel pump is held.

According to another advantageous exemplary embodiment of the invention, a contribution to further simplifying the construction of the holding part is made if the holding part has a flange to be inserted into a mounting orifice of the fuel tank and a strut, fastened to the flange, for holding the receiving part and the holding element.

According to another advantageous exemplary embodiment of the invention, the holding part has a particularly low weight if the strut is designed to be tubular. Furthermore, as result of this design, a cable duct or a return line can be laid in the strut. Moreover, the strut can be designed as a portion of the return line. This leads to a further simplification in the mounting of the feed unit according to the invention.

The invention permits numerous embodiments. In order to make its basic principle even clearer, one of these is illustrated in the drawing and is described below.

BRIEF DESCRIPTION OF THE DRAWING

FIG. 1 illustrates a feed unit according to an exemplary embodiment of the invention.

DETAILED DESCRIPTION OF THE PREFERRED EMBODIMENTS

The feed unit has a fuel pump 2 held by a holding part 1 and intended for feeding fuel out of a fuel tank, not illustrated, to an internal combustion engine of a motor vehicle. For the sake of clarity, the holding part 1 is illustrated as being partly in section. The fuel pump 2 has, on its underside, a fuel filter 3 intended to be arranged in a bottom region of the fuel tank and, on its top side, a connection piece 4 for an admission line leading to the internal combustion engine. Furthermore, the fuel pump 2 has a junction plug 5 for supplying electric current to an electric motor, not illustrated, intended for driving said fuel pump.

The holding part 1 has a holding element 6 axially securing the fuel pump 2 and a tubular receiving part 7. The receiving part 7 and the holding element 6 are connected to a flange 9 via a strut 8. The flange 9 serves for closing a mounting orifice of the fuel tank. The strut 8 is of tubular design and has a connection piece 10 for a return line leading back from the internal combustion engine of the motor vehicle. A spring element 11 prestressed against the fuel pump 2 is supported on the inside of the tubular receiving part 7. The holding element 6 supports the fuel pump 2 in a conically designed region.

The fuel pump 2 has a conical contraction 12 in the region of the spring element 11. The spring element 11 is of U-shaped design and is arranged with the closed end pointing toward the holding element 6. For mounting, first the fuel pump 2 is led through the receiving part 7, until it comes up against the holding element 6. The spring element 11 is subsequently pushed over the fuel pump 2 as far as the contraction 12. The drawing shows by way of example a fuel pump 2 of medium power rating. Higher-power and therefore longer fuel pumps can, of course, also be mounted in the holding part 1 if the contraction 12 is located within the receiving part 7.

The spring element 11 is manufactured from a harder material than the receiving part 7 and has an edge 13 projecting radially outward. The spring element 11 digs with this edge 13 into the receiving part 7 and is consequently held positively in the axial direction.

As a result, the spring element 11 can prestress the fuel pump 2 against the holding element 6 and hold said fuel pump in the axial and radial directions. For this purpose, the holding element has projections 14, 15 coming to bear on the conical region of the fuel pump 2.

What is claimed is:

1. A fuel feed unit to be arranged in a fuel tank comprising:

a holding part for holding the fuel pump in at least two regions spaced from one another, wherein the holding part is further comprised of a holding element;

a receiving part having a side inner surface at least partially surrounding the fuel pump; a spring element in contact with the side inner surface of the receiving part, and wherein the spring element on the receiving part can be locked at different distances from the holding element.

2. The feed unit as claimed in claim 1, wherein the receiving part is tubular.

3. The feed unit as claimed in claim 1, wherein the spring element surrounds the fuel pump annularly.

4. The feed unit as claimed in claim 1, wherein the holding element has projections for laterally holding the fuel pump.

5. A fuel feed unit to be arranged in a fuel tank comprising:

a holding part for holding the fuel pump in at least two regions spaced from one another, wherein the holding part is further comprised of a holding element and a receiving part at least partially surrounding the fuel pump and having at least one spring element, and wherein the spring element on the receiving part can be locked at different distances from the holding element and wherein the spring element is a plastic molding.

6. The feed unit as claimed in claim 1, wherein the spring element is comprised of a metal.

7. A fuel feed unit to be arranged in a fuel tank comprising:

a holding part for holding the fuel pump in at least two regions spaced from one another, wherein the holding part is further comprised of a holding element and a receiving part at least partially surrounding the fuel pump and having at least one spring element, and wherein the spring element on the receiving part can be locked at different distances from the holding element and wherein the spring element has a substantially U-shaped cross section.

8. The feed unit as claimed claim 1, wherein the spring element has an edge prestressed against the receiving part.

9. The feed unit as claimed in claim 1, wherein the receiving part is comprised of a softer material than a material of the spring element.

10. The feed unit as claimed in claim 1, wherein the spring element prestresses the fuel pump against the holding element.

11. A fuel feed unit to be arranged in a fuel tank comprising:

a holding part for holding the fuel pump in at least two regions spaced from one another, wherein the holding part is further comprised of a holding element and a receiving part at least partially surrounding the fuel pump and having at least one spring element, and wherein the spring element on the receiving part can be locked at different distances from the holding element and wherein the fuel pump has a contraction on its side facing away from the holding element, and wherein the spring element contacts the region of the contraction.

12. The feed unit as claimed in claim 11, wherein the contraction is conical.

13. The feed unit as claimed in claim 7,wherein the U-shaped spring element is arranged with its closed end pointing toward the holding element.

14. The feed unit as claimed in claim 1, wherein the holding part has a flange inserted into a mounting orifice of the fuel tank and a strut, fastened to the flange.

15. The feed unit as claimed in claim 1 wherein the strut is tubular.

* * * * *